United States Patent [19]

Sandino

[11] 4,351,536

[45] Sep. 28, 1982

[54] ICE SKATE ATTACHMENT

[76] Inventor: Hector M. Sandino, 24451 Peacock St., El Toro, Calif. 92630

[21] Appl. No.: 178,362

[22] Filed: Aug. 15, 1980

[51] Int. Cl.[3] ..... A63C 17/18

[52] U.S. Cl. ..... 280/7.13; 280/11.12; 280/11.18

[58] Field of Search ..... 280/7.13, 11.12, 11.18, 280/11.17, 11.16, 11.15, 11.14, 11.3, 11.28

[56] References Cited

U.S. PATENT DOCUMENTS

| | | | |
|---|---|---|---|
| 310,923 | 1/1885 | Wardwell | 280/7.13 |
| 2,454,321 | 11/1948 | Howard | 280/7.13 |
| 2,874,970 | 2/1959 | Mall | 280/7.13 |
| 2,985,461 | 5/1961 | Lynn et al. | 280/7.13 |
| 3,212,786 | 10/1965 | Florjancic et al. | 280/11.12 |
| 3,526,976 | 9/1970 | Jacobs | 280/7.13 X |
| 3,954,278 | 5/1976 | McLeod | 280/11.12 X |

*Primary Examiner*—Joseph F. Peters, Jr.

*Assistant Examiner*—Milton L. Smith

*Attorney, Agent, or Firm*—Knobbe, Martens, Olson, Hubbard & Bear

[57] ABSTRACT

An ice skating attachment can be interchangeably attached to conventional roller skate foot plates so that a foot receiving device on which such a foot plate is mounted can serve both as a roller skate or as an ice skate. The ice skating blade of the attachment is mounted on the foot plate by means of a pair of support members which are constructed in accordance with standard foot plate dimensions. Thus, the upper surfaces of the support members conform to the lower surfaces of standard foot plates and are attachable thereto in substantially the same manner as most roller skate trucks. The attachment is inexpensively manufactured by an injection molding process during which the ice skating blade is secured to the support members to form a unitary integral device that requires no assembly.

1 Claim, 6 Drawing Figures

Fig. 1
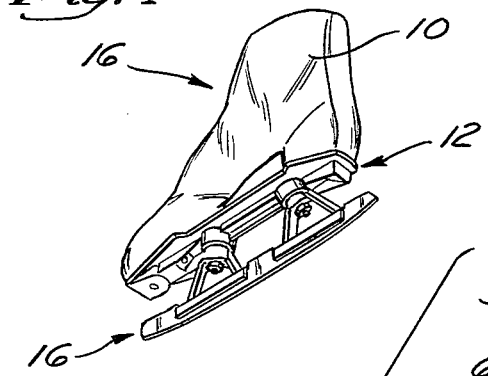
Fig. 2
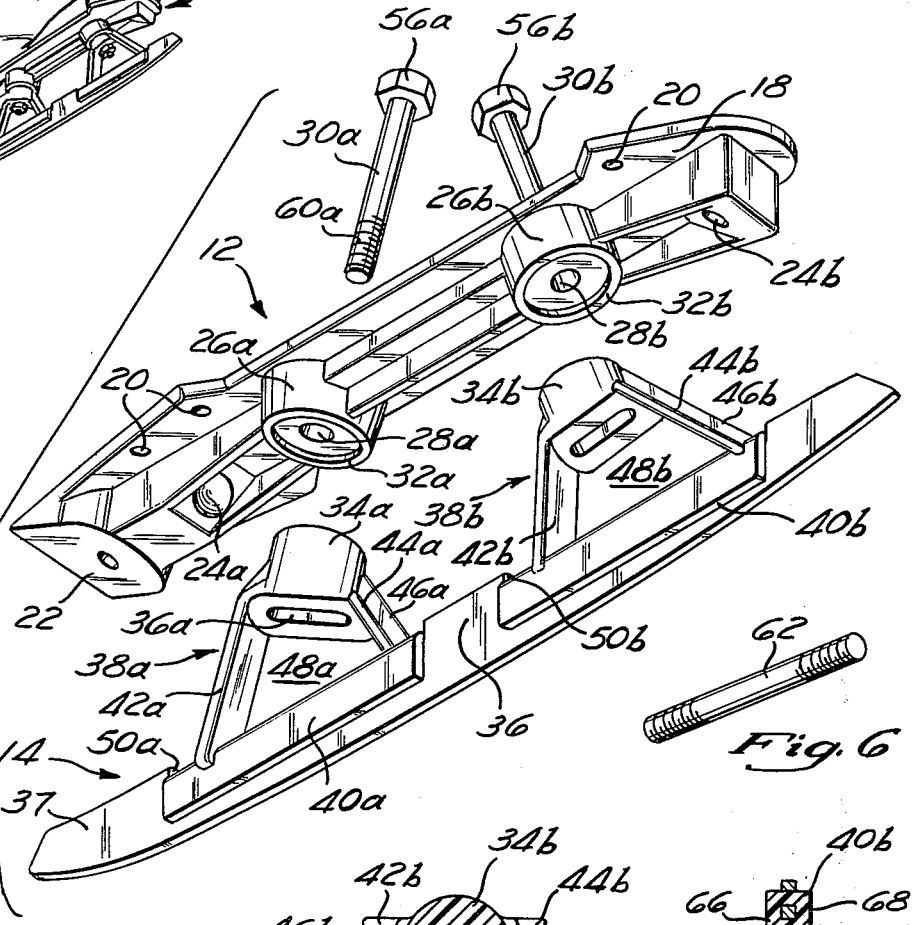
Fig. 6
Fig. 4
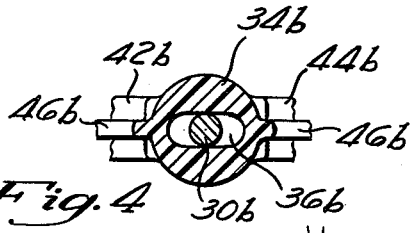
Fig. 5
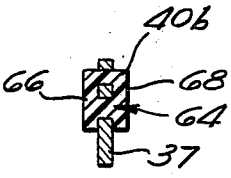
Fig. 3
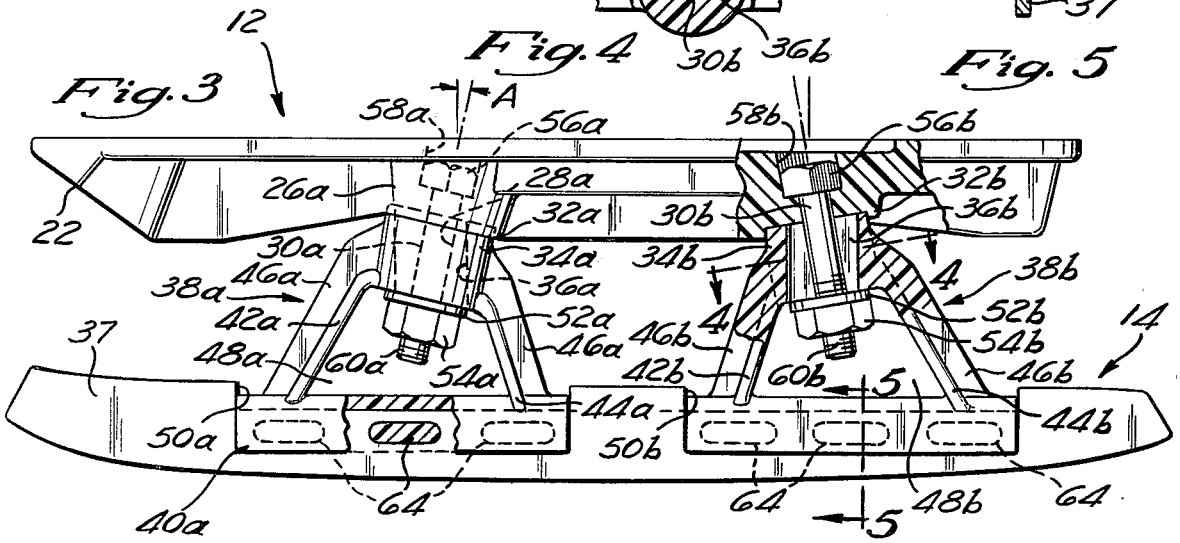

ICE SKATE ATTACHMENT

BACKGROUND OF THE INVENTION

The present invention relates to ice skating devices, and, more particularly, to ice skating attachments which permit a roller skate to also function as an ice skate.

The sport or recreation of roller skating has witnessed a tremendous surge in popularity. Although this activity is still just as popular as it probably ever was among children, the recent rise in popularity has primarily been among teenagers and young adults. At the same time, ice skating has remained a very popular sport or recreation among the general public. However, enthusiasts of both sports have found the expense of purchasing both types of skates prohibitive. As a result, there is a great consumer demand for a device which permits a roller skate to also serve as an ice skate. Furthermore, there is a tremendous need for an ice skating device which is inexpensive and can be interchangeably attachable to a variety of roller skates made by different manufacturers.

The typical roller skate chassis consists of some type of foot receiving device, such as a shoe or boot, a foot plate which is mounted on the bottom or sole of the boot, and two trucks which are assembled to the foot plate. The roller skate trucks typically include the wheel axles and the wheels of the roller skate. These trucks are securely mounted on the lower surface of the foot plate by means of an action pin assembly which includes a bolt or "action pin" that is passed through the plate and a portion of the truck. The action pin passes through a planar, cylindrical portion of the foot plate called a "boss". The bottom surface of conventional foot plates is provided with two such bosses for mounting the front and rear trucks of the roller skate.

In some roller skate chassis, the action pin is "top loaded"; that is, the pin is inserted downwardly through the boss so that the head of the bolt is embedded in the plate and a nut is used on the opposite end of the bolt to secure the truck to the plate. In other roller skate chassis, the pin is "bottom loaded" since it is inserted upwardly through the truck and is screwed into a threaded hole in the boss. Thus, the head of the pin serves to secure the truck to the foot plate.

Regardless of whether a foot plate is top or bottom loaded; however, the bosses of both types of plates generally exhibit certain standard characteristics. For example, the front and rear bosses of the plate typically are inclined in opposite directions at an angle of about 10° in order to facilitate turning of the roller skate. In addition, the bosses are usually about 1 inch in diameter and are spaced on the foot plate a standard distance which varies only with the size of the shoe on which the plate is mounted. That is, as the length of the shoe increases, so does the length of the foot plate and the boss spacing thereon.

In the past, there have been ice skating devices which were attachable to roller skate foot plates. Ice skate attachments of the prior art, however, generally have not been interchangeable. That is, they are not typically attachable to different roller skate foot plates. Rather, as in the device shown in U.S. Pat. No. 3,526,976 to Jacobs, ice skate attachments of the prior art are attachable to only one particular foot plate device. Thus, there remains a need for an ice skate attachment which can be interchangeably attached to a variety of roller skate foot plates to permit the roller skate to also serve as an ice skate.

SUMMARY OF THE INVENTION

The ice skate attachment of the present invention is provided with a pair of adaptors which are engageable with the bosses on conventional roller skate foot plates. These adaptors are constructed in accordance with the standard dimensions exhibited by conventional roller skate foot plates. Thus, the present attachment can be utilized with a variety of foot plates, permitting the foot receiving devices on which such foot plates are mounted to serve interchangeably as roller skates or as ice skates.

In the preferred embodiment of the present invention, the ice skating blade of the attachment is mounted beneath a pair of support members which serve to attach the blade to the foot plate. Each support member includes the adaptor for mating with the boss on the foot plate, a U-shaped mounting saddle which fits over the blade and attaches it to the support member, and a pair of struts which support the adaptor above the mounting sleeve. The adaptors of the present attachment have a standard diameter, inclination and separation which permit them to interchangeably conform to the bosses of many different foot plates of a corresponding size. In addition, the size of the attachment can be easily varied by adjusting the distance separating the adaptors to conform to the standard separation of the bosses on a foot plate of that particular foot size or range of sizes.

Each adaptor is provided with a slotted opening which is large enough to permit the action pin of the roller skate truck assembly to pass through. The support member has a large central opening so that a nut can be attached to the threaded end of the action pin extending below the adaptor in order to securely mount the ice skate attachment of the present invention to a foot plate. Thus, for most foot plates, the same fastening hardware which attaches the truck to the foot plate can also be utilized in connection with the present ice skate attachment.

Another important feature of the ice skate attachment of the present invention is the inexpense associated with its manufacture. The attachment is a one piece, integral device which is injection molded from a strong, durable plastic material. Furthermore, the molding of the present attachment is accomplished in a single step so as to eliminate the time and expense of assembly. The blade of the attachment is provided with several openings along its upper edge, and the blade is placed in the mold so that this upper edge is adjacent the mounting saddle portion of the mold. As the molten plastic is injected into the mold, the support members are separately but simultaneously formed around the blade. As a result, the plastic which flows into the saddle portion of the mold, also passes through the holes in the upper edge of the blade. Thus, upon hardening, this plastic serves to securely attach the blade to the support members.

DESCRIPTION OF THE DRAWINGS

FIG. 1 is a perspective view of a roller skate shoe and foot plate device including the ice skate attachment of the present invention;

FIG. 2 is an exploded perspective view illustrating a conventional roller skate foot plate and the present ice skate attachment;

FIG. 3 is a side view illustrating the ice skate attachment of the present invention completely assembled to a roller skate foot plate;

FIG. 4 is a cross sectional view taken along line 4—4 of FIG. 3 illustrating the construction of the adaptor of the ice skate attachment and its slotted opening;

FIG. 5 is a cross sectional view taken along line 5—5 of FIG. 3 illustrating the manner in which the blade is secured to the ice skate attachment; and FIG. 6 is a perspective view of a double threaded action pin used in assemblying the attachment.

DETAILED DESCRIPTION OF THE INVENTION

FIG. 1 illustrates a typical roller skate shoe or boot 10 having a conventional roller skate foot plate 12 mounted to the sole thereof. The ice skate attachment 14 of the present invention is secured to the foot plate 12 so that the roller skate can also function as an ice skate 16.

FIGS. 2 and 3 illustrate in more detail the manner in which the ice skate attachment 14 of the present invention is assembled to a conventional roller skate foot plate. The roller skate foot plate 12, for purposes of this description, is that which is described in more detail and claimed in applicant's co-pending application, Ser. No. 106,837, filed Dec. 26, 1979, now abandoned. However, it should be pointed out that the ice skate attachment 14 of the present invention can be utilized with conventional roller skate foot plates of the general type shown in FIGS. 2 and 3, and it is not limited in use to the specific foot plate 12 shown. In fact, this interchangeability is an important feature of the present ice skate attachment 14 which permits it to have wide spread applicability and utility.

As shown in FIG. 2, the foot plate 12 consists of an elongate planar base 18 which has several holes 20 for use in attaching the plate 12 to a foot receiving device or shoe 10. The front portion of the foot plate is provided with an inclined surface or pad 22 upon which a toe stop (not shown) can be mounted. Just behind this pad 22, there is a front aperture **24*a* and a front circular planar boss 26*a* having a hole 28*a* which extends entirely through the plate 12. The purpose of the aperture 24*a* is to permit a roller skate truck (not shown) to pivot relative to the foot plate 12, thus permitting the roller skate to turn. The front truck is securely attached to the plate 12 by means of a front action pin 30*a* which extends through the hole 28*a* in the front boss 26*a*. Similarly, at the rear portion of the foot plate 12, there is a second boss 26*b* and an aperture 24*b* for attaching a rear roller skate truck to the foot plate 12. As with the front boss 26*a*, a rear action pin 30*b* is inserted through a hole 28*b* in the rear boss 24*b*. The foot plate 12 shown in FIGS. 2 and 3 is of the top loading variety since the action pins are inserted downward through a non-threaded hole in the bosses. However, as will be described in more detail below, the present attachment 14 is equally attachable to a bottom loading foot plate. Both the front boss 26*a* and rear boss 26*b* are provided with short peripheral retaining walls 32*a* and 32*b***, respectively.

The ice skate attachment 14 of the present invention, shown in FIG. 2, comprises front and rear cylindrical adaptors **34*a* and 34*b*. As will be described in more detail below, these adaptors 34*a* and 34*b* engage the front and rear bosses 26*a* and 26*b*, respectively, on the bottom surface of the foot plate 12 and serve, in conjunction with the action pins 30*a* and 30*b*, to securely attach the ice skate attachment 14 to the foot plate 12. This is accomplished in part by means of slotted openings 36*a* and 36*b* which extend completely through the adaptors 34*a* and 34*b*, respectively. The attachment 14 itself includes an ice skating blade 37 which is securely mounted by two support members 38*a* and 38*b*, corresponding to the front adaptor 34*a* and rear adaptor 34*b*. respectively. Each support member 38*a* and 38*b* is of a similar construction and assembled to the foot plate 12** in a similar manner, as described below.

In addition to the adaptor 34, each support member 38 also includes a U-shaped mounting saddle 40 and a pair of support struts 42 and 44. As shown in FIG. 2, the mounting saddle 40 serves to mount or attach the ice skating blade 37 to the support member 38, and the struts 42 and 44 connect the adaptor 34 to the mounting saddle 40 of each support member 38. The struts 42 and 44 are also provided with ribs 46 which strengthen the connection between the adaptor 34 and the mounting saddle 40 and permit each support member 38 to withstand the weight of a skater. The adapter 34, struts 42 and 44, and mounting saddle 40, of each support member 38 define an open central area 48 in the support member 38 which facilitates the assembly of the attachment 14 to the foot plate 12, as will be described in more detail below. The ice skating blade 37 is of a typical metal construction and is provided with a pair of indentations **50*a* and 50*b* located at the attachment areas with front and rear support members 38*a* and 38*b*. These indentations 50*a* and 50*b* permit the plate 12 to be closer to the bottom of the ice skating blade 37 and the ground, thereby increasing the stability of the assembled ice skate 16**.

FIG. 3 illustrates the ice skate attachment 14 of the present invention completely assembled to a conventional foot plate 12. The adaptor 34 of each support member 38 is designed and constructed to fit flush against a boss 26 on the foot plate 12. The attachment 14 is then secured to the foot plate 12 by means of the action pin 30 and a suitable fastener device, preferably a washer 52 and nut 54. In the top loading foot plate 12 shown in FIGS. 2 and 3, the head 56 of the action pin 30 is inserted into a slot or opening 58 in the top of the foot plate 12 which prevents the pin 30 from rotating. The lower, threaded portion 60 of the action pin 30 extends through the slotted opening 36 in the adaptor 34 and into the open central area 48 of the support member 38, facilitating the attachment of the washer 52 and nut 54 on the lower end 60 of the action pin 30 to securely attach the ice skate attachment 14 to the foot plate 12.

A significant feature of the present invention lies in its ability to be attached to various foot plates of a corresponding size. This interchangeability is achieved by constructing the adaptor 34 of the support member 38 of the attachment 14 according to conventional of standard dimensions in the roller skate industry. Specifically, the diameter of the adaptor 34, its inclination, and the distance separating the pair of adaptors **34*a* and 34*b*, are such that the ice skate attachment 14** of the present invention can be utilized in connection with many different roller skate foot plates.

The diameter of the lower planar surface of most foot plate bosses is about one inch. Thus, the adaptor 34 of the present attachment 14 is approximately one inch in diameter which permits it to fit securely over the boss 26 and within the retaining wall 32, as shown in FIG. 3. Thus, the adaptors 34 are held securely in place against the foot plate 12 not only by means of the action pin 30 and nut 54 but also by the retaining wall 32 which serves to resist lateral or transverse forces which may be exerted on the foot plate 12 and/or on the ice skate attachment 14.

The adaptors 34 are also constructed to exhibit a standard inclination which permits them to conform to the bosses 26. As exemplified in FIG. 3, most action pins 30 are inclined slightly in opposite directions, contributing to the ability of a roller skate to turn. This angle A of opposite inclination is approximately 10° with respect to the vertical and is a standard angle of inclination in the industry, with the exception of roller skate foot plates designed for and used by professional speed skaters. As a result of this action pin inclination A, the lower surface of each boss 26 must also be inclined 10° with respect to the horizontal. Therefore, the upper surfaces of the adaptor 34 are also inclined about 10° in opposite directions so as to correspond to the bosses 26 of the foot plate 12. This construction permits close engagement between the adaptors 34 and the bosses 26 and enables the present attachment 14 to be utilized with a variety of foot plates made by different manufacturers.

Another dimension which is substantially standard in the roller skating industry is the distance separating the two bosses for a given shoe size. For example, for mens' shoe size 7–8, the inside edges of the bosses on the appropriate foot plate are separated by approximately three inches. The attachment 14 of the present invention incorporates the standard separations for each particular foot size or range thereof so that the adaptors 34 will conform as precisely as possible to the bosses 26 of different roller skate foot plates. This feature, together with the standard diameter and inclination of the adaptors 34, permits the ice skate attachment 14 of the present invention to be used with many different foot plates of a corresponding size. In addition, any unusual variations in these distances or dimensions are compensated for by the elongate slot 36 which extends through the adaptor 34, as will be described in more detail in connection with FIG. 4.

Thus, almost any conventional roller skate can be converted to a functional, useful ice skate by use of the ice skate attachment 14 of the present invention. The steps of the assembly process can be described as follows. First, the roller skate trucks are removed from the foot plate. For the foot plate 12 of the type shown in FIGS. 2 and 3 (i.e., a top-loading foot plate), removal of the roller skate trucks leaves the action pins 30 extending down from the boot 10 and foot plate 12 assembly. The slotted openings 36 in the adaptor 34 of the attachment 14 are then passed over the action pins 30 until the upper surfaces of the adaptors 34 securely engage the lower surfaces of the bosses 26 and the ends 60 of the action pins 30 extend into the open central areas 48 of the support members 38. The washers 52 and nuts 54 can then be placed over the threaded ends 60 of the action pins 30 and tightened to securely attach the ice skate attachment 14 to the foot plate 12. Thus, this quick and simple process is all that is necessary to transform a conventional roller skate into an ice skate. In addition, with a top-loading foot plate 12 of the type shown, no additional fastener or hardware is necessary since the same items used to attach the roller skate trucks to the foot plate 12 are also used to mount the ice skate attachment 14.

Furthermore, bottom loading foot plates are also easily utilized in connection with the present ice skate attachment 14 to permit the roller skate to which the plate is attached to also serve as an ice skate. As explained above, in a bottom loading foot plate, the hole 28 in the boss 26 is threaded and the action pin 30 is screwed into this hole 28 from below. Thus, the heads 56 on the action pins 30 serve to secure the trucks to the foot plate 12. To assemble the present attachment 14 to such a bottom loading foot plate, the trucks are first removed by unscrewing the action pins 30. Then, a double threaded action pin 62, shown in FIG. 6, is screwed into the threaded hole 28 in the boss 26 to effectively convert a bottom loading foot plate into a top loading foot plate. The slotted openings 36 in the adaptors 34 are then passed over the downwardly extending ends of the double threaded action pins 62 until the adaptors 34 engage the bosses 26 and the pins 62 extend into the open central areas 48 in the support members 38, as described above. The attachment 14 can then be secured to the foot plate 12 by means of washers 52 and nuts 54, as shown in FIG. 3.

The construction of the ice skate attachment 14 of the present invention can be described with reference to FIGS. 3, 4, and 5. The attachment 14 is injection molded from a tough durable plastic material, preferably a modified nylon. Thus, the support members 38 of the attachment 14 are each a unitary, one-piece element and are simultaneously constructed from a single mold. The ice skating blade 37 is inserted into the mold before injection of the molten plastic. As shown in FIG. 3, the interior walls of the slotted openings 36 in the adaptors 34 are vertical, thereby facilitating removal of the molded attachment 14 from the mold. Thus, the elongate nature of these slots 36, illustrated best in FIG. 4, permits them to accommodate the angular orientation of the action pins 30. Furthermore, the length of the slots 36 is slightly oversized, permitting the adaptors 34 to compensate for slight variations from the standard in the inclination or separation of the bosses 26 on the foot plate 12. Preferably, the slotted openings 36 in the adaptors 34 are each about 1 inch long and ⅜ inch wide.

An important feature of the present invention is that the blade 37 is attached to the support members 38 of the attachment 14 in the molding process so that no costly assembly is required. The indented portions 50 in the upper surface of the blade 37 are provided with several oblong openings 64, as shown in FIG. 3. In manufacturing the attachment 14, the blade 37 is placed in the mold prior to molding so that the indentations 50 are located adjacent the portions of the mold which correspond to the U-shaped mounting saddles 40. Then, as molten plastic is injected into the mold, it fills the mounting saddle portion of the mold, flows through the oblong openings 64 in the blade 37, and surrounds its indented portions 50. As shown in FIG. 5, the plastic material, upon hardening, extends completely from one side 66 of the mounting saddle **40*b*, through the opening 64, to the other side 68, thereby securely mounting the blade 37 in the support member 38*b* of the attachment 14. Thus, the ice skating attachment 14** of the present invention can be inexpensively and easily manufactured.

What is claimed is:

1. An ice skate device for attachment to a variety of roller skate foot plates of the type having front and rear bosses for the mounting of roller skate trucks, each said boss having an opening and an action pin passing therethrough, said device comprising:

an ice skating blade;

front and rear support members for attaching said blade to said roller skate foot plate, each said support member being of a one piece, unitary plastic molded construction and comprising:

U-shaped mounting means for mounting said blade;

adaptor means engageable with said bosses and having an opening for receiving said action pin; and strut means for connecting said adaptor means to said mounting means, said strut means forming a central opening to permit attachment of a fastener on said action pin for attaching said ice skate device to said roller skate foot plate can function interchangeably as a roller skate foot plate or as an ice skate foot plate.

* * * * *